US012208442B2

(12) United States Patent
Letzel et al.

(10) Patent No.: US 12,208,442 B2
(45) Date of Patent: Jan. 28, 2025

(54) METHOD AND SPRAYING APPARATUS FOR THE THERMAL SURFACE TREATMENT OF A METAL PRODUCT

(71) Applicant: SMS group GmbH, Düsseldorf (DE)

(72) Inventors: Dirk Letzel, Ratingen (DE); Uwe Plociennik, Ratingen (DE); Volker Mers, Wuppertal (DE); Axel Stavenow, Düsseldorf (DE); Ina Hüllen, Düsseldorf (DE); Harminder Singh, Düsseldorf (DE); Ingo OlgeMöller, Düsseldorf (DE)

(73) Assignee: SMS group GmbH, Düsseldorf (DE)

( * ) Notice: Subject to any disclaimer, the term of this patent is extended or adjusted under 35 U.S.C. 154(b) by 0 days.

(21) Appl. No.: 18/025,308

(22) PCT Filed: Aug. 31, 2021

(86) PCT No.: PCT/EP2021/073941
§ 371 (c)(1),
(2) Date: Mar. 8, 2023

(87) PCT Pub. No.: WO2022/058152
PCT Pub. Date: Mar. 24, 2022

(65) Prior Publication Data

US 2023/0330743 A1 Oct. 19, 2023

(30) Foreign Application Priority Data

Sep. 18, 2020 (DE) ..... 102020211720.9

(51) Int. Cl.
*B22D 11/124* (2006.01)
*B22D 11/22* (2006.01)

(52) U.S. Cl.
CPC ..... *B22D 11/225* (2013.01); *B22D 11/1246* (2013.01)

(58) Field of Classification Search
CPC .. B22D 11/124; B22D 11/1246; B22D 11/225
(Continued)

(56) References Cited

U.S. PATENT DOCUMENTS 5,720,335 A * 2/1998 Osada ..... B22D 11/124 164/486

FOREIGN PATENT DOCUMENTS

CN 110605368 A * 12/2019
DE 19681466 T1 7/1998
(Continued)

OTHER PUBLICATIONS

International Search Report and Written Opinion for PCT Appl. No. PCT/EP2021/073941 mail date Dec. 22, 2021, 13 pages.

*Primary Examiner* — Kevin E Yoon
(74) *Attorney, Agent, or Firm* — Maine Cernota & Curran

(57) ABSTRACT

The invention relates to a method and to a spraying apparatus (10) for the thermal surface treatment of a metal product (1). The metal product (1) is conveyed in a transport direction (T) through a treatment section (12) of a spraying apparatus (10) equipped with cooling nozzles (16) while cooling fluid is discharged through the cooling nozzles (16) of the spraying apparatus (10) onto the surfaces of the metal product (1), wherein the metal product (1) has—viewed in the transport direction (T) of the metal product (1)—a front section (4) and a trailing rear section (5). The cooling of the surfaces of the metal product (1) within the spraying apparatus (10) occurs in such a manner that the rear section (5) of the metal product (1) is cooled more significantly than its front section (4). It is thereby achieved that an essentially uniform ferrite content forms in the material of the metal product (1) at a predetermined depth of the same over a longitudinal area extending between the front section (4) and the rear section (5).

12 Claims, 6 Drawing Sheets

(58) Field of Classification Search
USPC ..... 164/443, 444, 485, 486
See application file for complete search history.

(56) References Cited

FOREIGN PATENT DOCUMENTS

| | | | | | |
|---|---|---|---|---|---|
| DE | 102006056683 | A1 | | 7/2007 | |
| DE | 69431178 | T3 | | 3/2014 | |
| DE | 102017105614 | A1 | * | 9/2017 | ..... B22D 11/124 |
| EP | 3184202 | A1 | | 6/2017 | |
| WO | 9641024 | A1 | | 12/1996 | |
| WO | 0003042 | A1 | | 1/2000 | |
| WO | 2012069234 | A1 | | 5/2012 | |
| WO | WO-2018082883 | A1 | * | 5/2018 | ..... B21B 1/46 |

* cited by examiner

METHOD AND SPRAYING APPARATUS FOR THE THERMAL SURFACE TREATMENT OF A METAL PRODUCT

RELATED APPLICATIONS

This application is a national phase application filed under 35 USC § 371 of PCT Application No. PCT/EP2021/073941 with an International filing date of Aug. 31, 2021, which claims priority of DE Patent Application 10 2020 211 720.9 filed Sep. 18, 2020. Both of these applications are incorporated by reference in their entirety for all purposes.

FIELD OF THE INVENTION

The invention relates to a method for the thermal surface treatment of a metal product, and to a spraying apparatus provided for this purpose.

BACKGROUND OF THE INVENTION

It is known in the prior art to subject metal products, for example continuously cast products, to a heat treatment in the form of a thermal surface treatment. To this end, a metal product can be guided through a spraying chamber apparatus, wherein the metal product is continuously cooled inside this spraying chamber apparatus by discharging water onto a surface of the product. A surface quenching of the outer layer of the metal product is achieved in the process. Such a technology is disclosed, for example, in EP 0 650 790 B1.

For the processing of hot-rolled steel in the form of an intermediary steel product, it is known, for example from DE 196 81 466 T1, to subject the steel after a rolling step to an accelerated cooling at a rate of 12° C. to 20° C./second in order to achieve an exit temperature in the range of approximately 470° C. to approximately 570° C. A steel product treated in this manner obtains an increased hardness and strength with a preferred structure including a substantial percentage of fine-grained bainite.

In the aforementioned prior art, the heat treatment for a metal product occurs essentially uniformly, i.e. at the same cooling rates, over the length of the metal product. In this regard, the fact that a potential different energy content, which can occur over the length of a metal product to be cooled, is not adequately taken into account in the course of the production or manufacture of the metal product constitutes a drawback.

SUMMARY OF THE INVENTION

The basic object of the invention is accordingly to optimize the manufacture of a metal product with respect to its thermal surface treatment in order to be able to influence a resulting material structure, i.e. microstructure, of the metal product.

This object is achieved by means of a method and a spraying apparatus as are disclosed herein. Advantageous variants of the invention are indicated in the dependent claims.

The invention provides a method for the thermal surface treatment of a metal product, in particular in the form of a cast strand or a slab formed therefrom, wherein the metal product is conveyed in a transport direction through a treatment section of a spraying apparatus equipped with cooling nozzles while cooling fluid is discharged through the cooling nozzles of the spraying apparatus onto the surfaces of the metal product. The metal product has—viewed in the transport direction of the metal product—a front section and a trailing rear section. When this method is implemented, the rear section of the metal product is cooled more significantly than the front section of the metal product. As a result, an essentially uniform ferrite content forms in the material of the metal product at a predetermined depth of the same over a longitudinal area extending between the front section and the rear section of the metal product due to the extraction of heat by means of the cooling fluid discharged onto the surfaces of the metal product.

In an advantageous variant of the method according to the invention, the cooling nozzles are arranged at least in a first group and in a second group. It is provided in this connection that the second group of cooling nozzles is arranged downstream—viewed in the transport direction of the metal product—of the first group of cooling nozzles.

In an advantageous variant of the method according to the invention, the cooling nozzles are connected for the supply of cooling fluid to at least one frequency-controlled pump by means of which the cooling fluid is conveyed to the cooling nozzles in a predetermined quantity and at a predetermined pressure. It can be provided in this context that separate frequency-controlled pumps are respectively provided for the first group of cooling nozzles and for the second group of cooling nozzles. Alternatively, it can also be provided that the first and second groups of cooling nozzles are supplied with cooling fluid by only one central frequency-controlled pump, wherein at least one control valve is provided in a line between the frequency-controlled pump and the cooling nozzles of the first and second groups, by means of which control valve a targeted quantity of water and/or a predetermined pressure can be set with respect to the cooling fluid for the cooling nozzles of the first and second groups.

The present invention also provides a spraying apparatus for the thermal surface treatment of a metal product, in particular in the form of a cast strand or a slab formed therefrom, comprising a treatment section with an inlet area and an outlet area, wherein the metal product can be conveyed along the treatment section from the inlet area towards the outlet area in a transport direction, and a plurality of cooling nozzles from which a cooling fluid can respectively be discharged onto the surfaces of the metal product. The cooling nozzles are arranged at least in a first group and in a second group, wherein the second group of cooling nozzles is arranged—viewed in the transport direction of the metal product—downstream of the first group of cooling nozzles. The cooling nozzles of the first group and the cooling nozzles of the second group here are respectively connected to separate frequency-controlled pumps. By means of these respective frequency-controlled pumps, a predetermined quantity and/or a predetermined pressure can be set, preferably regulated, with respect to the cooling fluid for the cooling nozzles of the first group and for the cooling nozzles of the second group, respectively.

An alternative embodiment of the invention with independent status provides a—spraying apparatus for the thermal surface treatment of a metal product, in particular in the form of a cast strand or a slab formed therefrom, comprising a treatment section with an inlet area and an outlet area, wherein the metal product can be conveyed along the treatment section from the inlet area towards the outlet area in a transport direction, and a plurality of cooling nozzles from which a cooling fluid can respectively be discharged onto the surfaces of the metal product. The cooling nozzles are arranged at least in a first group and in a second group, wherein the second group of cooling nozzles is arranged—viewed in the transport direction of the metal product— downstream of the first group of cooling nozzles. The cooling nozzles of the first group and the cooling nozzles of the second group here are connected to at least one frequency-controlled pump, wherein at least one control valve is provided in a line between the frequency-controlled pump and the cooling nozzles of the first and second groups, by means of which control valve a quantity of water and/or a pressure can be set, preferably regulated, with respect to the cooling fluid for the cooling nozzles of the first and second groups.

In an advantageous variant of the spraying apparatus according to the invention, a control device is provided that is in signal communication with the frequency-controlled pump or frequency-controlled pumps and/or with the control valve. This makes it possible to control, preferably regulate, the operation of these pumps and/or the control valve as a function of at least one process parameter of the metal product. These process parameters of the metal product can include the temperature upstream and/or downstream of the spraying apparatus, the temperature at the top side and/or at the bottom side, and/or a ferrite content measured downstream of the spraying apparatus.

The invention is based on the key insight that the metal product, which can be a still continuous or endless cast strand or an individual slab formed therefrom, is cooled unevenly in relation to its longitudinal extension. Specifically, this is expressed in the method according to the invention in that the—viewed in the transport direction of the metal product—rear section of the metal product is cooled more significantly than its front section, whereby a targeted microstructure, namely an essentially uniform ferrite content, is achieved in a longitudinal area of the metal product extending between the front and rear sections. The cooling nozzles in the spraying apparatus according to the invention are arranged at least in a first group and in a second group precisely for this purpose, wherein these groups of cooling nozzles can be supplied—viewed in the transport direction of the metal product—with respectively different quantities of cooling fluid. This is achieved either by a suitable control of the separate frequency-controlled pumps to which the cooling nozzles of the respective first and second groups are connected, or by a suitable control of the at least one control valve provided in a line between the frequency-controlled pump and the cooling nozzles of the respective first and second groups.

In the course of the thermal surface treatment set out in the foregoing, which is characteristic of the present invention, a further objective is an energy content of the metal product that is as high as possible with a view to further processing following the thermal surface treatment. In other words, the metal product is cooled only to the extent necessary for the desired constant microstructural transformation in order to achieve the uniform ferrite content in the material of the metal product at a predetermined depth of the same, for example 5-10 mm, over a longitudinal area extending between the front section and the rear section of the metal product.

In an advantageous variant of the method according to the invention, a plurality of cooling nozzles are respectively arranged in the treatment section of the spraying apparatus above the metal product and/or below the metal product along the transport direction of the metal product. A cooling fluid is respectively sprayed under pressure from these cooling nozzles onto the surfaces of the metal product. This cooling fluid is expediently employed in the form of water or is water-based.

In order to realize the characteristic cooling of the metal product set out in the foregoing, which is more significant or intensive at the rear section than at the front section of the same, it is provided according to the present invention that the quantity and/or the pressure are set for the cooling fluid so as to be greater for the cooling nozzles of the first group than for the cooling nozzles in the second group. Such a supply of a greater quantity of cooling fluid and/or cooling fluid at a higher pressure to the cooling nozzles of the first group than to the second group of cooling nozzles is expediently set for the cooling nozzles at both the top side as well as the bottom side of the metal product.

In an advantageous variant of the invention, it can be provided that the temperature of the metal product is measured. This can occur—viewed in the transport direction of the metal product—upstream and/or downstream of the spraying apparatus. Furthermore, the temperature of the metal product can be measured at its top side and/or at its bottom side. In any case, the temperature measurement is carried out for the metal product in order for the quantity of cooling fluid discharged from the cooling nozzles of the spraying apparatus onto the surfaces of the metal product to be set or regulated as a function of this measured temperature of the metal product.

Analogously, the transport speed of a metal product in the form of an individual slab or the modification of this transport speed for the slab within the treatment section of the spraying apparatus can be set or regulated as a function of a measured temperature of the metal product. It is understood in this regard that, by means of the transport speed at which an individual slab is guided in the treatment section of the spraying apparatus past the cooling nozzles provided in the same, or by means of the targeted modification of said transport speed, it can be achieved that the front section of the slab is guided past these cooling nozzles faster than the rear section of the slab, with the consequence that—as discussed—the rear section of the slab is cooled more significantly.

A further option for a targeted influencing of the cooling of the metal product lies in the measurement of the surface quality of the metal product with respect to the percentage of ferrite content downstream—viewed in the transport direction of the metal product—of the spraying apparatus. This makes it possible to set or regulate the quantity of cooling fluid discharged from the cooling nozzles of the spraying apparatus onto the surfaces of the metal product, and/or the pressure of the same and/or the transport speed of the slab or the modification of this transport speed along the treatment section of the spraying apparatus, as a function of the measured ferrite content.

In the event that, according to an advantageous variant of the invention, the cooling nozzles are arranged along the treatment section of the spraying apparatus on both sides of the metal product, i.e. above and below it, it is expedient to select the quantity of water and/or the pressure for the cooling nozzles below the metal product so as to be greater than for the cooling nozzles arranged above the metal product. This can be achieved by having the cooling nozzles arranged at the bottom side of the metal product supplied with cooling fluid by their own frequency-controlled pump, which means that the cooling nozzles arranged at the top side of the metal product are supplied with cooling fluid by a separate frequency-controlled pump. In other words, the different supply to the cooling nozzles at the bottom side of the metal product compared to the cooling nozzles at the top side of the metal product is achieved by the fact that the cooling nozzles arranged below and above the metal product are respectively connected to different frequency-controlled pumps for the supply of cooling fluid.

In an advantageous variant of the invention, it can be provided that the thickness of the metal product for which the characteristic thermal surface treatment is implemented is at least 250 mm, and/or that a width of the metal product is at least 3000 mm.

In an advantageous variant of the invention, it can also be provided that the cooling fluid is discharged intermittently from the cooling nozzles onto the surfaces of the metal product. This yields the advantage that a controlled local extraction of heat can be achieved by means of intensive water cooling, for example at a specific point of the metal product relative to its longitudinal extension.

According to a further alternative embodiment of the invention with independent status, a spraying apparatus for the thermal surface treatment of a metal product in the form of an individual slab is provided, comprising a treatment section with an inlet area and an outlet area, wherein the metal product can be conveyed along the treatment section on a roller conveyor from the inlet area towards the outlet area in a transport direction, and a plurality of cooling nozzles from which a cooling fluid can respectively be discharged onto the surfaces of the metal product. At least one roller element of the roller conveyor is equipped with a motorized drive. Preferably, the roller element equipped with the motorized drive can be arranged adjacent to the treatment section.

In this last embodiment of the spraying apparatus according to the invention, it can be achieved via a control of the motorized drive with which at least one roller element of the roller conveyor is equipped that an individual slab is guided with its front section—viewed in the transport direction—past the cooling nozzles arranged in the treatment section faster than the rear section of the individual slab. As a result, the rear section of the individual slab is thus cooled more significantly than the front section of the same, with the consequence that, as already discussed in the foregoing, an essentially uniform ferrite content forms in the material of the slab at a predetermined depth of the same over a longitudinal area extending between the front section and the rear section of the slab.

In an advantageous variant of this last embodiment of the spraying apparatus according to the invention, a control device is provided that is in signal communication with the motorized drive of the roller element, namely in such a manner that the rotational speed or the circumferential speed of the roller element can be set and preferably regulated as a function of at least one process parameter of the metal product or individual slab.

In an advantageous variant of the invention, the at least one process parameter of the metal product as a function of which the quantity and/or the pressure for the cooling fluid can be set or regulated can be selected from the group consisting of temperature, ferrite content in the material of the metal product and/or geometry of the metal product, in particular with respect to its cross-section perpendicular to the transport direction.

The present invention gives rise to a technology for a targeted thermal surface treatment that enables an automated setting of the temperature for a metal product and of the resulting metal microstructure. For example, the targeted discharge of a larger quantity of cooling fluid through the cooling nozzles of the first group compared to the cooling nozzles of the second group has the effect that the rear section of the metal product is subjected to a locally controlled, more intensive cooling than the front section of the metal product.

The present invention enables an influencing of the surface quality and structure of a cast strand made of steel, in particular a cast strand of any product format, produced on a vertical continuous casting unit, a vertical continuous casting unit with bending (i.e. plant with a vertical section), a horizontal or a continuous arc casting unit (without a vertical section).

BRIEF DESCRIPTION OF THE DRAWINGS

Example embodiments of the invention are described in detail in the following with reference to schematically simplified drawings. The drawings show.

DETAILED DESCRIPTION

Figure 1:
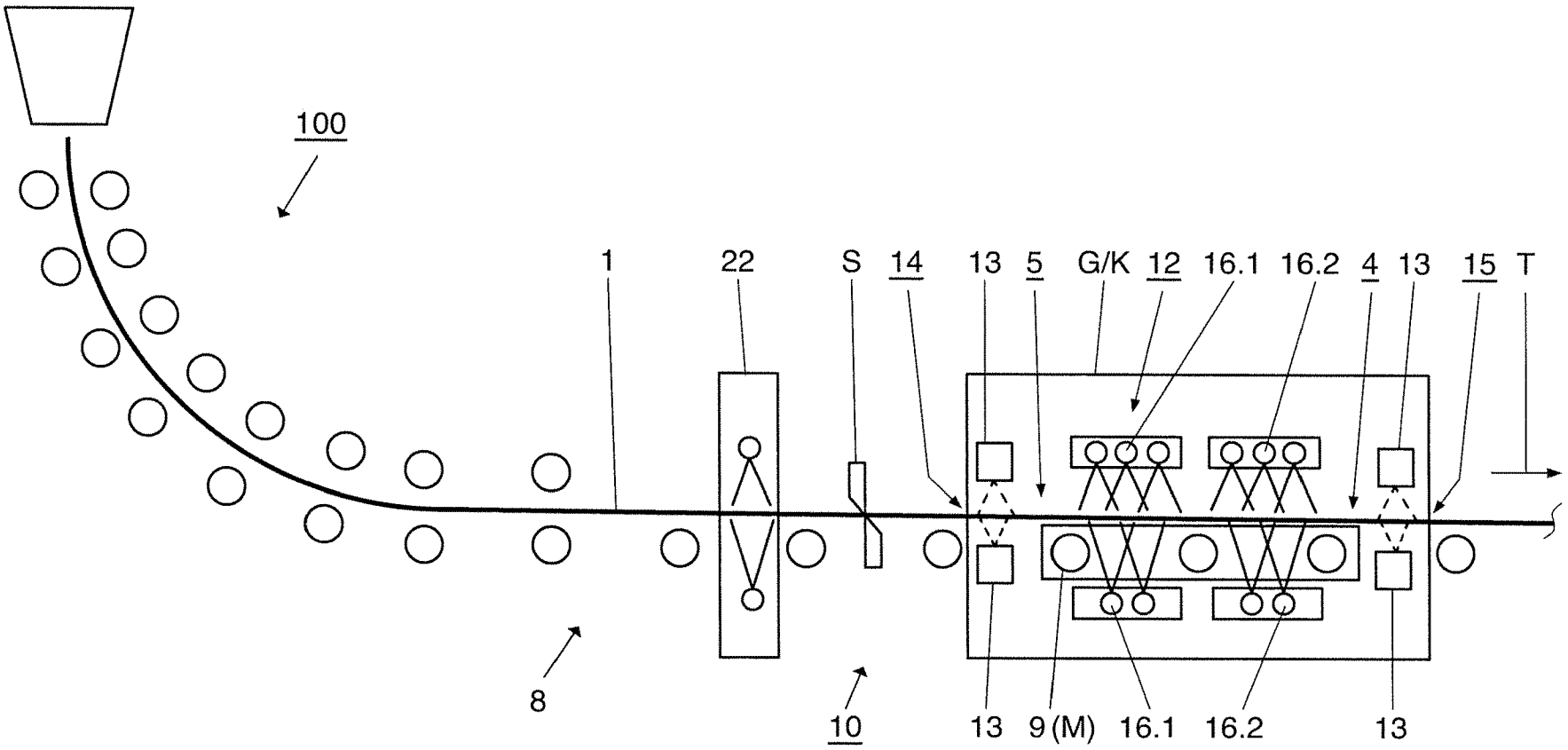
FIG. 1 a schematically simplified side view of a continuous casting unit which comprises a spraying apparatus according to the invention for the thermal surface treatment of a metal product and with which a method according to the invention can be implemented, FIG. 2 an enlarged illustration of the spraying apparatus of FIG. 1 according to a first embodiment, FIG. 3 an enlarged illustration of the spraying apparatus of FIG. 1 according to a second embodiment, FIG. 4 a simplified side view of a roller conveyor forming part of the continuous casting unit of FIG. 1, FIG. 5 a simplified side view of a roller conveyor forming part of the continuous casting unit of FIG. 1 according to a further embodiment, FIG. 6 a perspective view of a quick-change frame forming part of the spraying apparatus of FIGS. 2, and FIG. 7 a perspective view of a plurality of quick-change frames as shown in FIG. 6 combined into a spraying apparatus according to FIG. 2, and FIG. 8 a flowchart illustrating a method according to the invention and its implementation.

Preferred embodiments of a spraying apparatus 10 and of a corresponding method for the thermal surface treatment of a metal product according to the present invention in order to achieve a targeted microstructural transformation or a desired microstructure, namely an essentially uniform ferrite content, for the metal product are illustrated and explained in the following with reference to FIGS. 1-8. Identical features in the drawings are respectively provided with identical reference signs. It is in particular noted here that the drawings are illustrated merely in a simplified manner and are in particular not scaled.

FIG. 1 shows a basic, schematic side view of a continuous casting unit 100 equipped with the spraying apparatus 10.

The continuous casting unit 100 according to FIG. 1 comprises in a known manner a mould with a lower opening and thereby a vertical outlet in a downward direction. Molten metal, e.g. steel or a steel alloy, is filled into the mould up to a mould level. A metal product 1 in the form of a cast strand 2 exits through the lower opening of the mould and then passes through a supporting strand guide while simultaneously being transferred to the horizontal.

The continuous casting unit 100 comprises a roller conveyor 8 with a plurality of roller elements 9 on which the cast strand 2 is conveyed further in the transport direction T after being transferred to the horizontal.

The continuous casting unit 100 according to FIG. 1 can be a thick slab unit with which it is possible to manufacture a cast strand 2 with a thickness of preferably 250 mm or potentially even greater casting thicknesses.

The spraying apparatus 10 according to the invention is arranged in a part of the continuous casting unit 100 in which the cast strand 2 has already been transferred to the horizontal. The function of the spraying apparatus 10 is the thermal surface treatment of the cast strand 2, to which end it is equipped with a plurality of cooling nozzles 16 provided in a treatment section 12 of the spraying apparatus 10.

The spraying apparatus 10 comprises a housing G. In a front area of the housing G—viewed in the transport direction T of the cast strand 2—an inlet area 14 for the cast strand 2 is formed, while in a rear area of the housing G—viewed in the transport direction T of the cast strand 2—an outlet area 15 is formed.

Provided inside the housing G next to the inlet area 14 and the outlet area 15 are respective temperature measurement devices 13 with which the temperature of the cast strand 2 can be determined both when entering the housing G and when exiting the housing G. These temperature measurement devices 13 can respectively be arranged above and below the cast strand 2, i.e. above and below the roller conveyor 8 on which the cast strand 2 is conveyed within the treatment section 12 of the spraying apparatus 10 in the transport direction T.

Regardless of whether the cast strand 2 enters the treatment section 12 of the spraying apparatus 10 as a continuous product, i.e. before being sectioned into a slab, or already in the form of an individual slab, it is noted that the metal product 1 located within the treatment section 12 of the spraying apparatus 10 invariably has—a front section 4—viewed in the transport direction T of the cast strand 2—with which the metal product 1 enters the treatment section 12 first. Analogously, the metal product has a rear section 5—viewed in the transport direction T of the cast strand 2—which trails the front section 4, i.e. is located upstream of the front section 4—again viewed in the transport direction T of the cast strand 2.

The individual cooling nozzles 16 are combined into at least two groups within the treatment section 12 of the spraying apparatus 10, namely into a first group 16.1 and into a second group 16.2. The second group 16.2 of cooling nozzles 16 is arranged here downstream—viewed in the transport direction T of the cast strand 2—of the first group 16.1 of cooling nozzles 16.

Both the first group 16.1 and the second group 16.2 respectively comprise cooling nozzles 16 arranged both at the top side 6 of the cast strand 2 as well as at the bottom side 7 of the latter. The top side 6 and the bottom side 7 of the cast strand are designated as such, for example, in FIG. 2 and FIG. 3.

The continuous casting unit 100 comprises a separating apparatus in the form of shears S arranged—viewed in the transport direction T of the cast strand 2—upstream of the spraying apparatus 10. Similarly, a cleaning apparatus 22, for example in the form of a descaler, is also arranged upstream of the spraying apparatus 10.

Different embodiments of the spraying apparatus 10 according to the invention are illustrated and explained in the following with reference to FIG. 2 and FIG. 3. Features of these two embodiments that correspond to features already explained in the foregoing in connection with FIG. 1 are not discussed.

Figure 2:
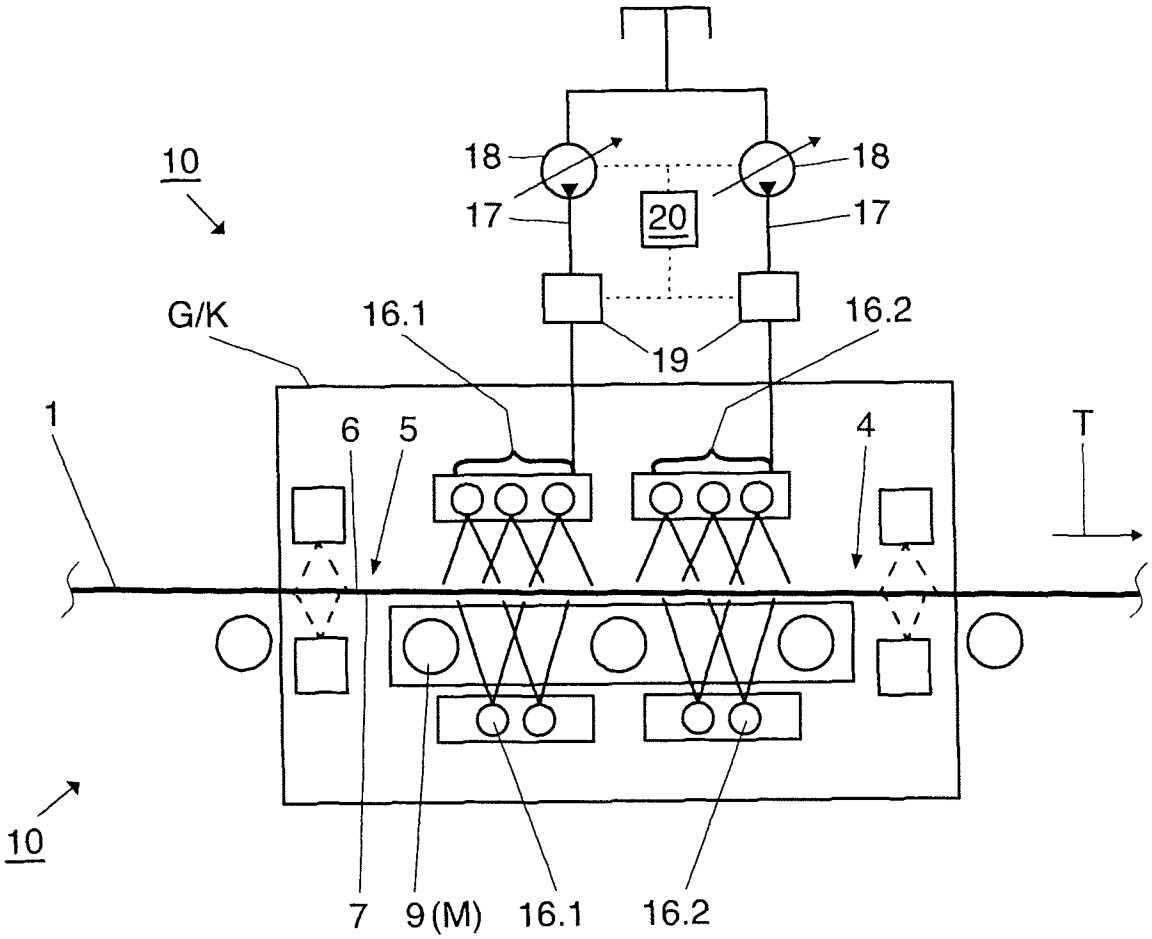

A first embodiment of the spraying apparatus 10 according to the invention is illustrated in FIG. 2. In this embodiment, separate frequency-controlled pumps 18 are provided with which a respectively separate supply of cooling fluid to the cooling nozzles 16 of the first group 16.1, on the one hand, and of the second group 16.2, on the other hand, occurs. To this end, the cooling nozzles 16 of the first group 16.1 and of the second group 16.2 are respectively connected via a line 17 to the frequency-controlled pump 18 allocated to the same.

The two frequency-controlled pumps 18 are in signal communication with a control device 20. Both of these pumps 18 are connected by lines not described in further detail to a tank or the like that contains cooling fluid. Operation of these pumps 20 can thus be suitably controlled or regulated by the control device 20 in order to supply cooling fluid to the cooling nozzles 16 of both the first group 16.1 and the second group 16.2.

Provided in the lines 17 between the frequency-controlled pumps 18 and the first group 16.1 and the second group 16.2, respectively, of cooling nozzles 16 are respective control valves 19, which are also in signal communication with the control device 20 and which can be actuated by these means. Whether or not cooling fluid is discharged onto the surfaces of the cast strand 2 can be controlled through a suitable operating position of these control valves 19.

Figure 3:
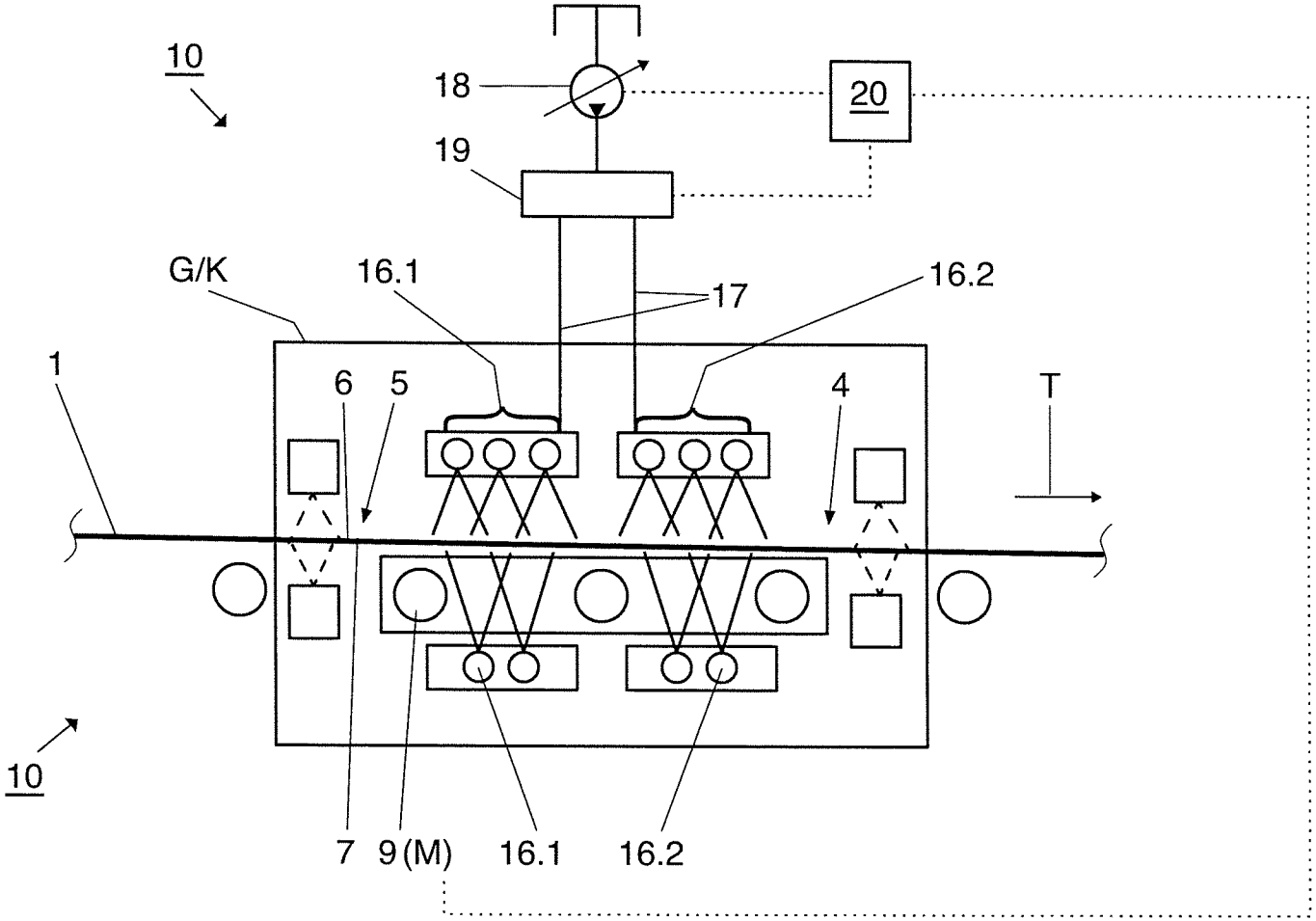

FIG. 3 shows a second embodiment of the spraying apparatus 10 according to the invention. In the second embodiment, in contrast to the first embodiment according to FIG. 2, the cooling nozzles 16 of both the first group 16.1 and the second group 16.2 are now connected to a common frequency-controlled pump 18 for the supply of cooling fluid. By means of a control valve 19 provided in a line 17 between the frequency-controlled pump 18 and the two groups 16.1 and 16.2 of cooling nozzles 16, it is possible to set the quantity of cooling fluid supplied as well as the pressure of the cooling fluid supplied to the cooling nozzles 16 of the first group 16.1 and the second group 16.2, respectively.

In the second embodiment according to FIG. 3, analogously to the first embodiment of FIG. 2, the frequency-controlled pump 18 and the control valve 17 can respectively be controlled or regulated by the control device 20.

In both embodiments of the spraying apparatus 10 according to FIG. 2 and FIG. 3, it can be provided that at least one roller element 9 of the roller conveyor 8 is equipped with a motorized drive M. Accordingly, this driven roller element is respectively designated as "9(M)" in the illustrations of FIG. 2 and FIG. 3. This driven roller element 9(M) is also in signal communication with the control device 20, as symbolized by the dotted line in FIG. 3, for example, and can accordingly be controlled by means of the control device 20.

The invention works as follows:

During the operation of the continuous casting unit 100, a metal product 1 is first produced in the form of a cast strand 2 which, upon exiting the mould, is initially conveyed through the supporting strand guide and, after being transferred to the horizontal, is conveyed further in the transport direction T on the roller conveyor 8. It can be provided at this stage that the surfaces of the cast strand 2 are cleaned by means of the cleaning apparatus 22, for example by discharging water under high pressure.

In the course of its conveyance on the roller conveyor 8, the metal product 1 also passes through the treatment section 12 of the spraying apparatus 10. A thermal surface treatment for the metal product 1 occurs via the targeted discharge of cooling fluid 16 through the cooling nozzles of the first group 16.1 and the second group 16.2 onto the surfaces of the metal product 1.

Figure 4:
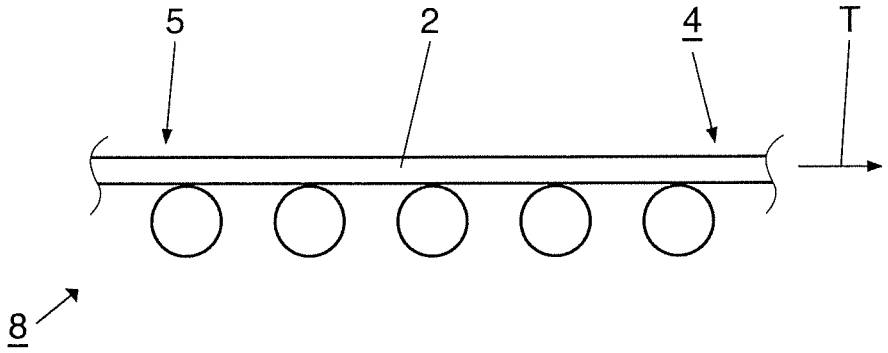
Figure 5:
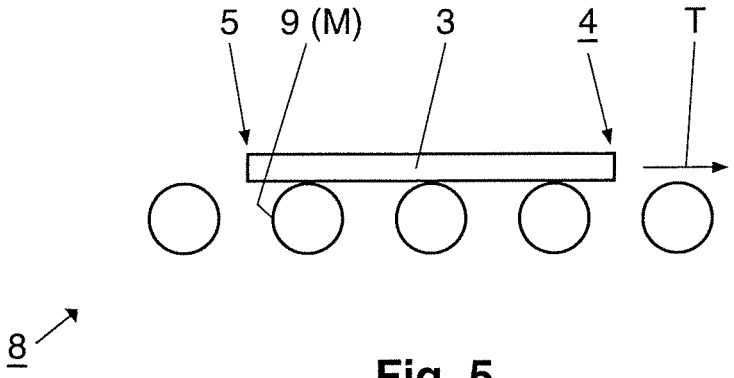

The metal product 1 in question can be a cast strand 2 which has not yet been sectioned and which accordingly constitutes an endless profile. This is depicted in the illustration of FIG. 4 in which such an endless cast strand 2 is conveyed on the roller conveyor 8 in the transport direction T.

The thermal surface treatment of the cast strand 2 within the treatment section 12 of the spraying apparatus 10 can occur in such a manner that cooling fluid is discharged from the cooling nozzles 16 of the first group 16.1 onto the surfaces of the cast strand 2 in a greater quantity and/or with a greater pressure compared to the cooling nozzles 16 of the second group 16.2. As a result, the trailing rear section of the cast strand 2 is cooled more significantly within the treatment section 12 of the spraying apparatus 10 than its front section 4. This cooling strategy achieves the result that an essentially uniform ferrite content forms in the material of the cast strand 2 at a predetermined depth of the same over a longitudinal area extending between the front section 4 and the rear section 5.

In accordance with the present invention, a thermal surface treatment within the treatment section 12 of the spraying apparatus 10 is also possible for an individual slab 3 formed beforehand from the cast strand 2. In this case, the cast strand 2 is sectioned by means of the shears S before it reaches the spraying apparatus 10 on the roller conveyor 8 so that an accordingly individual slab 3 thus enters the treatment section 12 of the spraying apparatus 10 or its housing G.

A conveyance of the individual slab 3 within the treatment section 12 of the spraying apparatus 10 in the transport direction T can be achieved by means of the driven roller element 9(M). This is depicted, for example, in the illustration of FIG. 5.

The cooling strategy already set out in the foregoing according to which a rear section 5 of the slab 3 is cooled more significantly than the front section 4 of the same can also be followed in cases where a metal product 1 in the form of an already sectioned slab 3 is subjected to a thermal surface treatment in the spraying apparatus 10. This can be achieved, as already discussed, by discharging cooling fluid from the cooling nozzles 16 of the first group 16.1 onto the surfaces of the slab 3 in a greater quantity and/or with a greater pressure compared to the cooling nozzles 16 of the second group 16.2. Additionally or alternatively, this cooling strategy can be achieved by conveying the individual slab 3 into the treatment section 12 of the spraying apparatus 10 or into its housing G in such a manner that the front section 4 of the slab 3 passes the cooling nozzles 16 faster than the trailing rear section 5 of the slab 5. This can be achieved by means of a suitable control of the driven roller element 9(M) by the control device 20.

Figure 6:
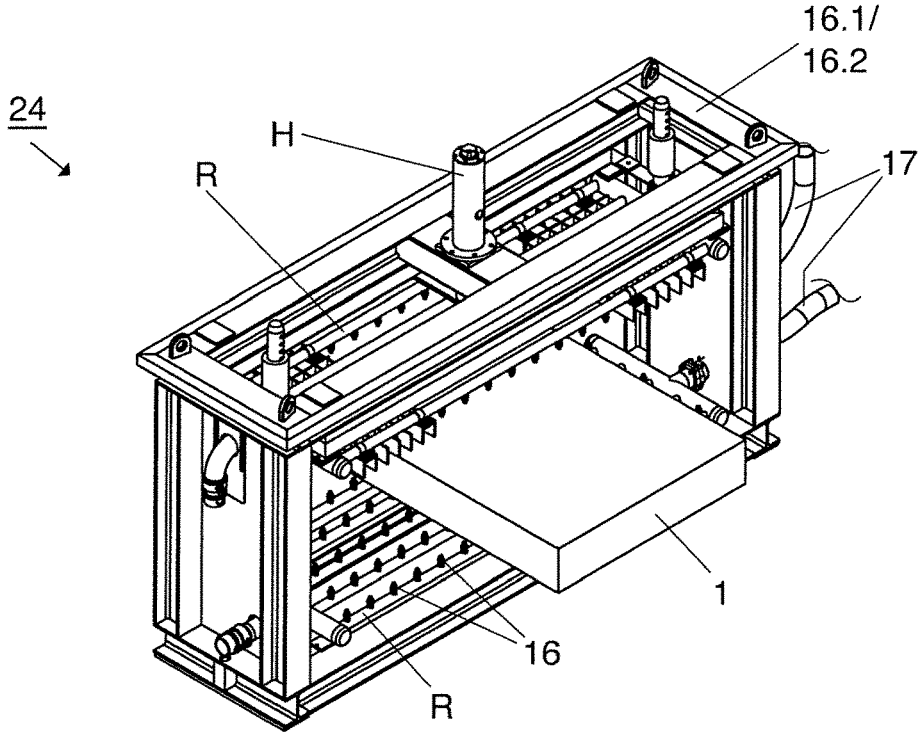
Figure 7:
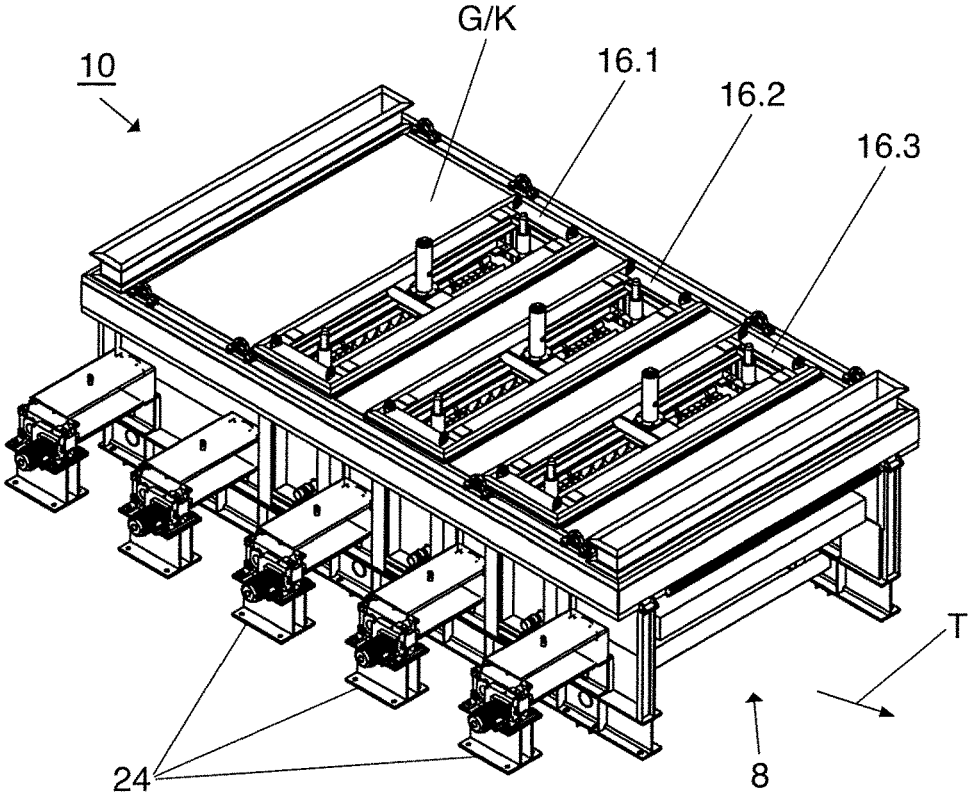

FIGS. 6 and 7 illustrate and elucidate further features of the spraying apparatus 10 according to the invention that can be implemented in all of the embodiments already set out in the foregoing.

FIG. 6 shows a simplified perspective illustration of a quick-change frame 24 in which a group of cooling nozzles 16 are arranged. A line 17 for cooling fluid runs laterally into such a quick-change frame 24 and is connected to spray pipes, to which the individual cooling nozzles 16 are attached. As already discussed in the foregoing, the line 17 is connected to a frequency-controlled pump 18 in order to feed cooling fluid to the cooling nozzles 16.

It is clear from the perspective illustration of FIG. 6 that the quick-change frame 24 is formed in cross-section in the shape of a rectangular profile that encloses a central opening. It is understood here that the roller conveyor 8, which is not illustrated in FIG. 6 for simplification, runs through this central opening. Cooling fluid can thus be applied to the top side 6 and to the bottom side 7 of the metal product 1 when said cooling fluid is discharged through the cooling nozzles 16 in the direction of the metal product 1.

The quick-change frame 24 is equipped with a height-adjustment device H. This height-adjustment device H affects the spray pipes arranged above the roller conveyor 8. It is accordingly possible by means of an actuation of this height-adjustment device H to modify the distance of the cooling nozzles 16 arranged above the metal product 1 in relation to the top side 6 of the metal product 1.

It is in particular noted here with regard to a quick-change frame 24 according to FIG. 6 that the latter can be employed for the cooling nozzles 16 of the first group 16.1 as well as for the cooling nozzles 16 of the second group 16.2. This means that, in the embodiments according to FIG. 2 and FIG. 3, a total of two quick-change frames 24 are employed, namely for the cooling nozzles 16 of the first group 16.1, on the one hand, and for the cooling nozzles 16 of the second group 16.2, on the other hand.

FIG. 7 shows a perspective view of the spraying apparatus 10 according to a further embodiment in which—viewed in the transport direction T of the metal product—a total of three groups of cooling nozzles 16 are arranged. In addition to the groups 16.1 and 16.2 already mentioned, a third group 16.3 of cooling nozzles 16 is now also provided, which is arranged—viewed in the transport direction T of the metal product—downstream of the second group 16.2.

It is understood that a quick-change frame 24 according to FIG. 6 can also be employed for the third group 16.3 of cooling nozzles 16 in order to arrange the cooling nozzles 16 above and below the metal product 1.

In the embodiment of FIG. 7, in which a total of three groups of cooling nozzles 16 are provided as just explained, it is understood that cooling fluid is discharged from the cooling nozzles 16 of the third group 16.3 in a smaller quantity and/or with a lower pressure than from the cooling nozzles 16 of the second group 16.2. In other words, the quantity of cooling fluid discharged from the cooling nozzles 16 and/or the pressure of the same are steadily reduced for the three groups 16.1, 16.2 and 16.3, in that order, along the transport direction T.

It can be provided that the third group 16.3 of cooling nozzles 16 is allocated to the front section 4 of the metal product 1. The cooling nozzles 16 of the second group 16.2 are then accordingly located approximately in an area between the front section 4 and the rear section 5 of the metal product 1.

The quick-change frames 24 are positioned along the roller conveyor 8 so as to be integrated in the housing G of the spraying apparatus 10, whereby a closed housing chamber K is formed at least in the area of the treatment section 12 of the spraying apparatus 10. A top cover is provided in the upper area of this housing chamber K, which is designated by "D" in the illustration of FIG. 7.

With regard to the closed housing chamber K set out in the foregoing, it is understood that the inlet area 14 and the outlet area 15 of the housing chamber K are respectively equipped with a gate function in order to ensure that the metal product 1 can enter the housing chamber K and that the metal product 1 can exit the housing chamber K, respectively.

With regard to the individual groups of cooling nozzles 16, it is in particular noted here that a distance between these groups—viewed in the transport direction T—can be modified so as to set the groups relative to one another. This applies analogously both to the embodiment of FIG. 2 and FIG. 3 in which a first group 16.1 and a second group 16.2 of cooling nozzles 16 are respectively provided, as well as to the embodiment of FIG. 7 in which a total of three groups 16.1, 16.2 and 16.3 are provided for the cooling nozzles 16. Such an adjustment of a distance between the groups of cooling nozzles 16 can be readily implemented when, as discussed, a quick-change frame 24 according to FIG. 6 is respectively used for these groups.

In all embodiments of the spraying apparatus 10 according to the invention set out in the foregoing, the housing G can be equipped with a water vapour suctioning apparatus (not shown). This water vapour suctioning device allows water vapour that can form inside the closed housing chamber K when a metal product 1 is subjected to a thermal surface treatment inside the treatment section 12 of the spraying apparatus 10 to be suitably suctioned.

Figure 8:
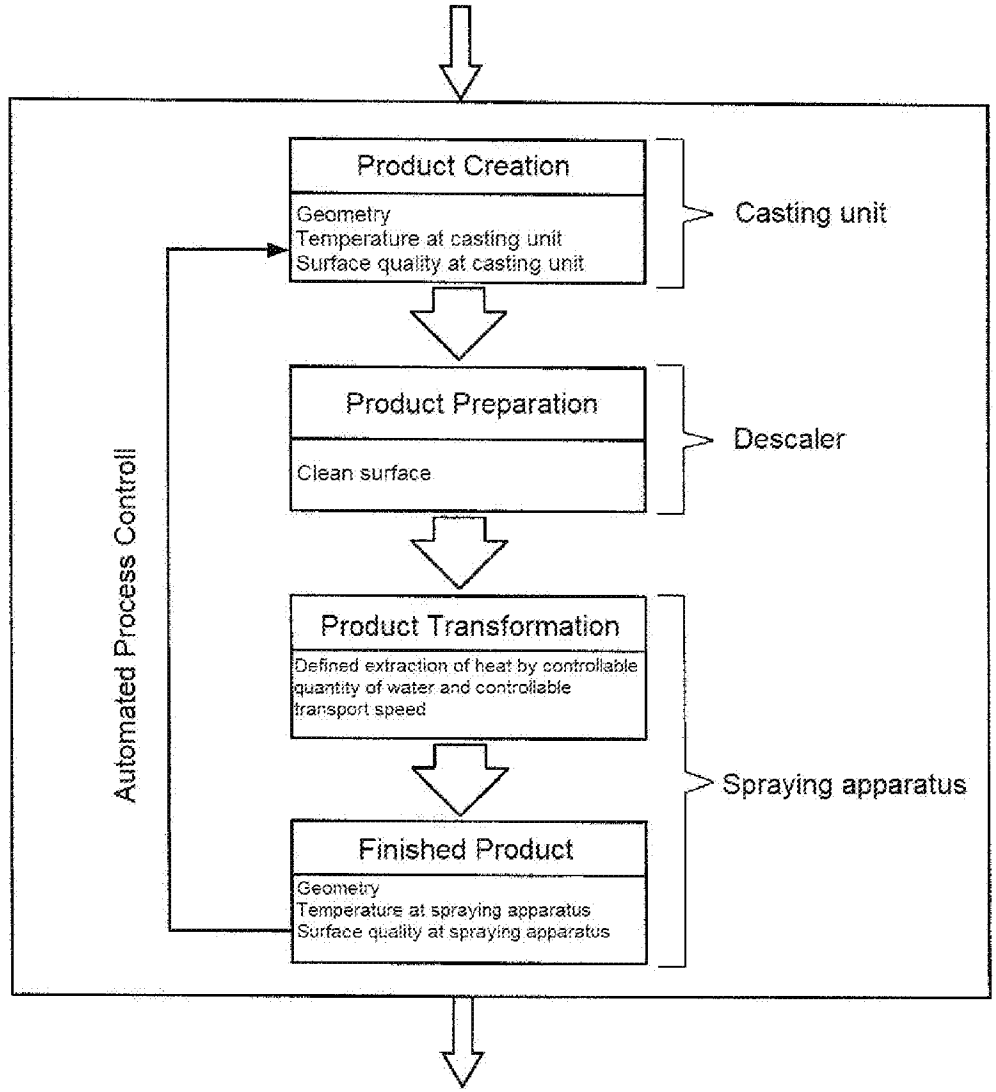

Further features for carrying out a thermal surface treatment method according to the invention are indicated in the flowchart of FIG. 8. With regard to the spraying apparatus 10, it is emphasized that a defined extraction of heat can be achieved for the metal product 1 by means of a controllable quantity of water. In the case of the treatment of an individual slab 3, this can also be achieved by means of a controllable transport speed at which the slab 3 is conveyed into the treatment section 12 of the spraying apparatus 10 and past the cooling nozzles 16.

Furthermore, the flowchart of FIG. 8 illustrates that it is possible to implement an automated process control that influences the operation of the continuous casting unit 100 by means of individual process parameters, which can include geometry, the measured temperature of the metal product 1 inside the spraying apparatus 10 in its inlet area 14 and/or outlet area 15 and/or the surface quality of the metal product 1 measured downstream of the spraying apparatus 10.

LIST OF REFERENCE SIGNS

1 Metal product
2 Cast strand
3 Slab
4 Front section (of the metal product 1)
5 Trailing rear section (of metal product 1)
6 Top side (of the metal product 1)
7 Bottom side (of the metal product 1)
8 Roller conveyor
9 Roller element
10 Spraying apparatus
12 Treatment section
13 Temperature measurement device
14 Inlet area
15 Outlet area
16 Cooling nozzles
16.1 First group of cooling nozzles 16
16.2 Second group of cooling nozzles 16
16.3 Third group of cooling nozzles 16
17 Line
18 Frequency-controlled pump
19 Control valve
20 Control device
22 Cleaning apparatus (e.g. descaler)
24 Quick-change frame
100 Continuous casting unit
D Top cover
G Housing
H Height-adjustment device
K Housing chamber
M Motorized drive (for one roller element)
R Spray pipes
S Shears
T Transport direction
v Transport speed (of the slab 3)

What is claimed is:

1. A spraying apparatus for thermal surface treatment of a metal product that is a cast strand or a slab formed therefrom, the spraying apparatus comprising:

a treatment section having an inlet area and an outlet area, wherein the metal product can be conveyed along the treatment section from the inlet area towards the outlet area in a transport direction (T); and a plurality of cooling nozzles from which a cooling fluid can respectively be discharged onto surfaces of the metal product;

wherein:

the cooling nozzles are arranged at least in a first group and in a second group the second group of cooling nozzles is arranged downstream-viewed in the transport direction (T) of the metal product-of the first group of cooling nozzles;

the cooling nozzles of the first group and the cooling nozzles of the second group are respectively connected to separate frequency-controlled pumps; and a predetermined quantity and/or a predetermined pressure can be separately set and/or regulated, with respect to the cooling fluid for the cooling nozzles of the first group and for the cooling nozzles of the second group, respectively, by means of the respective frequency-controlled pumps, wherein a distance between the first group of cooling nozzles and the second group of cooling nozzles in the transport direction (T) of the metal product can be modified so as to set said groups relative to one another.

2. The spraying apparatus of claim 1, further comprising a control device that is in signal communication with the frequency-controlled pump or pumps and/or the control valve in such a manner that the operation of the pump or pumps and/or of the control valve can be controlled, and/or regulated, as a function of at least one process parameter of the metal product.

3. The spraying apparatus of claim 1, wherein:

the metal product can be conveyed along the treatment section on a roller conveyor from the inlet region towards the outlet region in the transport direction (T); and at least one roller element of the roller conveyor is equipped with a motorized drive (M), wherein the roller element equipped with the motorized drive (M) is arranged adjacent to the treatment section.

4. The spraying apparatus of claim 1, wherein the first group of cooling nozzles and the second group of cooling nozzles are respectively accommodated in separate quick-change frames.

5. The spraying apparatus according to claim 1, further comprising a housing (G) in which a treatment section is provided, wherein:

the housing is equipped with a water vapour suctioning device;

the housing (G) is in the form of a chamber (K) and is designed so as to be essentially closed;

an inlet area and an outlet area of the housing chamber (K) are respectively equipped with a gate function configured to ensure that the metal product can enter the housing chamber (K) and that the metal product can exit the housing chamber (K), respectively.

6. A spraying apparatus for thermal surface treatment of a metal product that is a cast strand or a slab formed therefrom, the spraying apparatus comprising:

a treatment section having an inlet area and an outlet area, wherein the metal product can be conveyed along the treatment section from the inlet area towards the outlet area in a transport direction (T); and a plurality of cooling nozzles from which a cooling fluid can respectively be discharged onto surfaces of the metal product;

wherein;

the cooling nozzles are arranged at least in a first group and in a second group;

the second group of cooling nozzles is arranged downstream-viewed in the transport direction (T) of the metal product-of the first group of cooling nozzles;

the cooling nozzles of the first group and the cooling nozzles of the second group are connected to at least one frequency-controlled pump; and at least one control valve is provided in a line between the frequency-controlled pump and the cooling nozzles of the first and second group, said at least one control valve enabling flows and/or pressures of the cooling fluid to be set and/or regulated separately for the cooling nozzles of the first and second groups, respectively wherein a distance between the first group of cooling nozzles and the second group of cooling nozzles in the transport direction (T) of the metal product can be modified so as to set said groups relative to one another.

7. The spraying apparatus of claim 6, further comprising a control device that is in signal communication with the frequency-controlled pump or pumps and/or the control valve in such a manner that the operation of the pump or pumps and/or of the control valve can be controlled, and/or regulated, as a function of at least one process parameter of the metal product.

8. The spraying apparatus of claim 7, wherein the at least one process parameter of the metal product is selected from the group consisting of temperature, ferrite content in the material of the metal product, and geometry of the metal product with respect to its cross-section perpendicular to the transport direction (T).

9. The spraying apparatus of claim 6, wherein:

the metal product can be conveyed along the treatment section on a roller conveyor from the inlet region towards the outlet region in the transport direction (T); and at least one roller element of the roller conveyor is equipped with a motorized drive (M), wherein the roller element equipped with the motorized drive (M) is arranged adjacent to the treatment section.

10. The spraying apparatus of claim 6, wherein the first group of cooling nozzles and the second group of cooling nozzles are respectively accommodated in separate quick-change frames.

11. The spraying apparatus of claim 6, further comprising a height-adjustment device (H) by means of which at least some of the cooling nozzles arranged at a top side of the metal product are height-adjustable, so that it is possible to set a distance of these cooling nozzles relative to the roller conveyor.

12. The spraying apparatus according to claim 6, further comprising a housing (G) in which a treatment section is provided, wherein:

the housing is equipped with a water vapour suctioning device;

the housing (G) is in the form of a chamber (K) and is designed so as to be essentially closed;

an inlet area and an outlet area of the housing chamber (K) are respectively equipped with a gate function configured to ensure that the metal product can enter the housing chamber (K) and that the metal product can exit the housing chamber (K), respectively.

* * * * *